US005941273A

United States Patent [19]

Petrovich

[11] Patent Number: 5,941,273

[45] Date of Patent: Aug. 24, 1999

[54] DRAIN TRAP APPARATUS

[76] Inventor: Svetozar Petrovich, 6517 N. Caldwell Ave., Chicago, Ill. 60646

[21] Appl. No.: 08/950,898

[22] Filed: Oct. 15, 1997

[51] Int. Cl.[6] ..... F16K 13/10; F16K 37/00

[52] U.S. Cl. ..... 137/247.49; 137/247.27; 137/247.35; 137/247.49; 137/551

[58] Field of Search ..... 137/247.27, 247.35, 137/247.39, 247.49, 551

[56] References Cited

U.S. PATENT DOCUMENTS

| | | | |
|---|---|---|---|
| 227,411 | 5/1880 | Burgess | 137/247.27 X |
| 277,888 | 5/1883 | Connolly | 137/247.35 X |
| 452,526 | 5/1891 | Moore et al. | 137/247.27 X |
| 764,422 | 7/1904 | Burgess | 137/247.35 X |
| 880,975 | 3/1908 | Conrad | 137/247.39 X |
| 919,701 | 4/1909 | Donovan | 137/247.49 |
| 1,097,865 | 5/1914 | Lauth | 137/247.35 |
| 1,288,731 | 12/1918 | Stanford | 137/247.35 |
| 1,958,712 | 5/1934 | Nance | 137/247.35 |
| 2,113,721 | 4/1938 | Dame | 137/247.39 X |
| 3,313,314 | 4/1967 | Burke et al. | 137/247.27 |
| 3,908,208 | 9/1975 | McIlroy | 137/247.49 X |
| 4,158,897 | 6/1979 | Cocherel | 137/247.35 X |
| 4,254,512 | 3/1981 | Soderstrom | 137/247.27 X |
| 5,063,616 | 11/1991 | Bresnahan | 137/247.49 X |
| 5,159,724 | 11/1992 | Vasper | 137/247.35 X |
| 5,203,369 | 4/1993 | Hwang | 137/247.39 |

*Primary Examiner*—John Rivell

[57] ABSTRACT

A trap apparatus associated with a drain comprising a fluid inlet, a first chamber, second chamber, a fluid outlet and a structure for retaining fluid. The fluid inlet is capable of accepting in flowing fluid. The first chamber member is associated with the fluid inlet. The second chamber member is associated with the first chamber member and is joined thereto at a transition region. This transition region is configured to facilitate radial flow from the first chamber member through the transition region and into the second chamber member. The fluid outlet is associated with the second chamber member. The retaining structure retains fluid in the transition region so as to maintain the transition region submerged. The invention further includes a drainage trap.

5 Claims, 3 Drawing Sheets

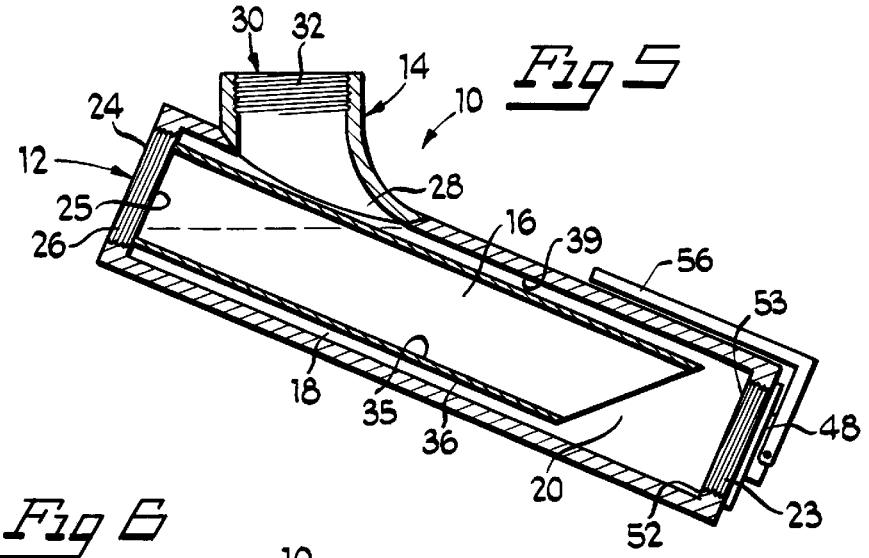
Fig 5
Fig 6
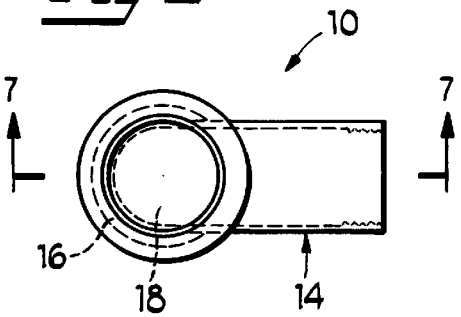
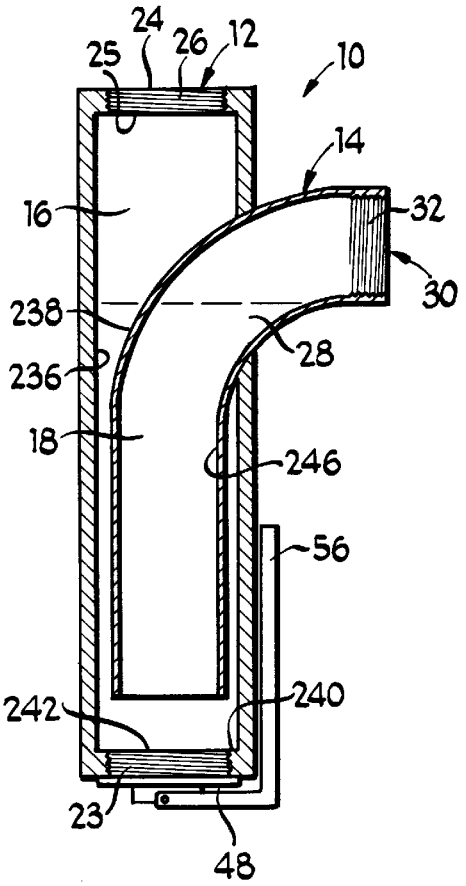
Fig 7
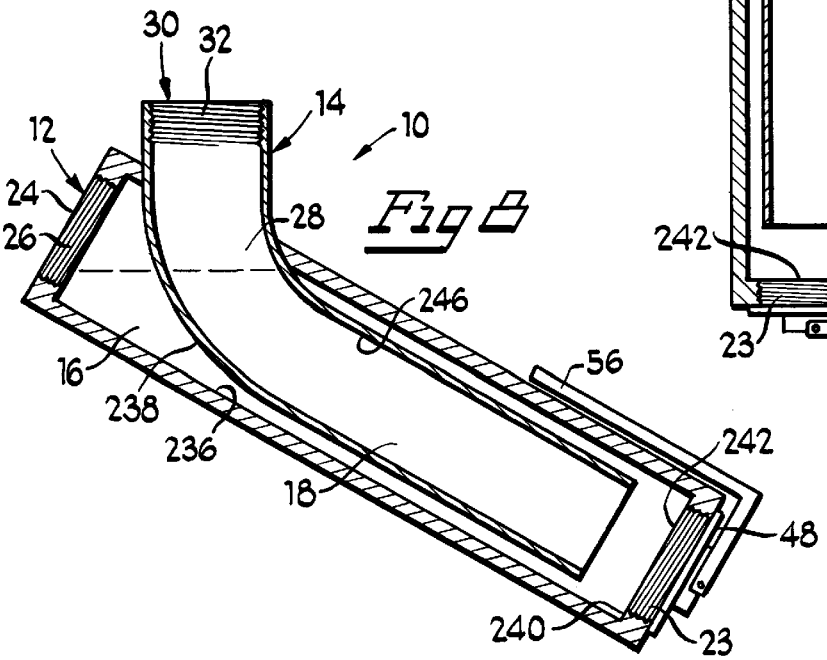
Fig 8

DRAIN TRAP APPARATUS

BACKGROUND OF THE INVENTION

1. Field of the Invention

The invention is directed to drain trap apparatuses, and more particularly, to drain trap apparatuses for use in association with sink, vanity, shower, dishwasher and other drains in residential, commercial, industrial, and health care facilities, among other locations.

2. Background Art

The draining of water from sinks, showers and dishwashers, or other machinery has been known in the art. From the earliest days of running water, there has been a need to safely and effectively remove the waste water back to the sewer, the septic system, or other waste treatment mechanism.

While the elimination of water from the above devices has been met with some success, several problems have been incurred. Among these has been the problem that drains can create a pathway for smell, odor and air from the particular sewer or drainage system to enter back through the drain to the living space. Most commonly, this reverse flow problem has been solved with the introduction of the drain trap. Indeed, the common drain includes an s-pipe. In operation, the s-pipe region remains full of fluid after fluid stops flowing through the pipe. As such, the fluid forms a physical impediment to the air and odor, and, in turn, prevents the direct connection between the sewer system and living, inhabited, or generally utilized space or areas.

There are certain drawbacks to such a system having an s-pipe. For one, the s-pipe is a common source for clogs. This is because sediment rests at the low point of the s-pipe and eventually the drain may become clogged which is generally difficult to clean. Additionally, the s-pipe takes a substantial amount of room, and often times constrains the use of adjacent area. Moreover, the amount of fluid flow that the trap can handle is limited.

Further, such s-pipes generally cannot be altered to properly accommodate varying installations. For instance, venting, while undesirable, is utilized in current s-pipes to avoid the build-up of back pressure on drain traps. In certain situations, turbulent flow is experienced at the inlet during high flow conditions and/or in conditions where debris is present. It would be desirable to control the characteristics of this flow through the trap.

SUMMARY OF THE INVENTION

The invention comprises a drain trap associated with the drain which comprises a fluid inlet, a first chamber, a second chamber, a fluid outlet and means for retaining fluid within a transition region. The fluid inlet is capable of inflowing fluid. The first chamber is associated with the fluid inlet. The second chamber is associated with the first chamber and joined at the transition region. This in turn facilitates radial flow from first chamber through the transition region to the second chamber. The fluid outlet is associated with the second chamber. The retaining means retains fluid in the transition region which maintains the transition region submerged.

In a preferred embodiment, the invention further includes a cleaning member which facilitates cleaning of the transition region. In such an embodiment, the cleaning member may further include a threaded plug member inserted into the transition region. The cleaning member may further include a handle member which facilitates the removal and installation of the cleaning member.

In another preferred embodiment, the trap apparatus is attached to a drainage system, and the fluid inlet and fluid outlet each include threaded fittings for positive engagement with the engagement system.

In another preferred embodiment, the trap may further include a failure detection member. In such an embodiment, the failure detection member may comprise a region of thinner material which will leak upon wearing. This in turn will indicate that the sink trap may require replacement prior to a major failure.

In yet another preferred embodiment, the failure detection member comprises a double wall construction defining an inner cavity in at least a portion of the first chamber and second chamber. A drainage channel extends from the inner cavity through the outside of one of the first and second chambers where, upon failure of one of the double walls, fluid exists the drainage channel to in turn indicate an imminent major failure. This permits the replacement of the trap prior to such failure.

In yet another preferred embodiment, the first chamber is positioned within the second chamber. However, in another preferred embodiment, the second chamber is positioned within the first chamber. In such an embodiment, the fluid outlet extends from the second chamber and through a portion of the first chamber.

In a preferred embodiment, the first chamber comprises a cylindrically shaped member. In such an embodiment, the second chamber comprises a cylindrically shaped member concentric with the first chamber member. Additionally, the first and second chamber is positioned substantially vertically. In other embodiments, the first and second chambers are positioned at an angle between the vertical and the horizontal.

In another preferred embodiment the second chamber includes a branch inlet line that is configured to accept a drainage line from an outside source. The lower end of the branch inlet extends proximate to the transition region and below the entry region of the outlet.

Preferably, the trap further includes means for controlling the flow characteristics of the fluid. In such a preferred embodiment, the flow control means comprises a nozzle region of increasing diameter proximate the transition region. The flow control means may comprise vane members positioned within the second chamber. The vane members limit the circumferential flow of fluid within the second chamber.

In yet another preferred embodiment, the second chamber includes a lower surface. A portion of the lower surface is angled toward the outlet. This promotes the fluid flow through the outlet.

In another preferred embodiment the fluid outlet comprises an encasement member extending around the second chamber. A base member is releasably attachable to an upper region of the encasement member. The first chamber and the second chamber being associated with the base member so as to be together detachable from the encasement member. This facilitates cleaning or replacement of the first and second chamber without disruption of the encasement member.

The invention further comprises a drainage trap comprising a main drainage pipe, a positioning member, and a flexible drainage line. The main drainage pipe includes an inlet, an outlet and a branch inlet. The positioning member is associated with the main drainage pipe. The flexible drainage line extends from an outside device, to the positioning member, and, in turn, into attachment with the branch inlet. The positioning member facilitates the proper positioning of the flexible drainage line which creates a trap region.

In a preferred embodiment, the positioning member includes a leg member extending away from the main drainage pipe. The leg member includes a ring member having a diameter sufficient to receive the flexible drainage line. In another preferred embodiment, the positioning member is positioned on the opposite side of the branch inlet. In yet another preferred embodiment, the branch inlet is angled at an acute angle with respect to the main drainage pipe and in the direction of flow of fluid therethrough.

Preferably, the flexible drainage line includes a coupling proximate the positioning member for permitting releasable disengagement for purposes of cleaning.

BRIEF DESCRIPTION OF THE DRAWINGS

FIG. 5 of the drawings is a cross-sectional view of a second embodiment of the invention, oriented at an angle between the vertical and the horizontal;

FIG. 6 of the drawings is a top view of a third embodiment of the invention;

FIG. 7 of the drawings is a cross-sectional view of a third embodiment of the invention taken generally about lines 7—7 of FIG. 6;

FIG. 8 of the drawings is a cross-sectional view of a third embodiment of the invention, oriented at an angle between the vertical and the horizontal;

DETAILED DESCRIPTION OF THE DRAWINGS

Figure 1:
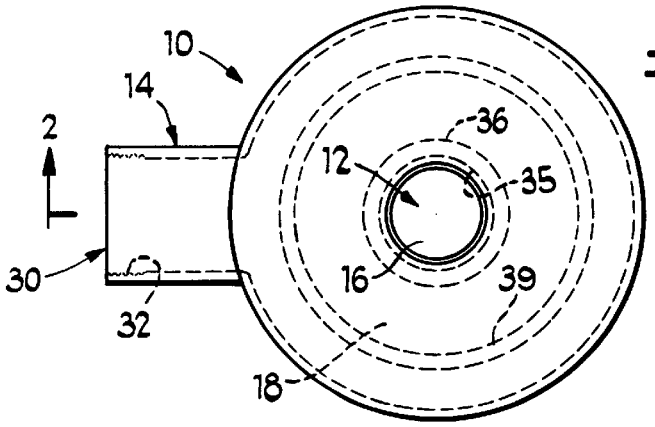
FIG. 1 of the drawings is a top view of a first embodiment of the invention.

While this invention is susceptible of embodiment in many different forms, there is shown in the drawings and will herein be described in detail, several specific embodiments with the understanding that the present disclosure can be considered as an exemplification of the principles of the invention and is not intended to limit the invention to the embodiments illustrated.

Figure 2:
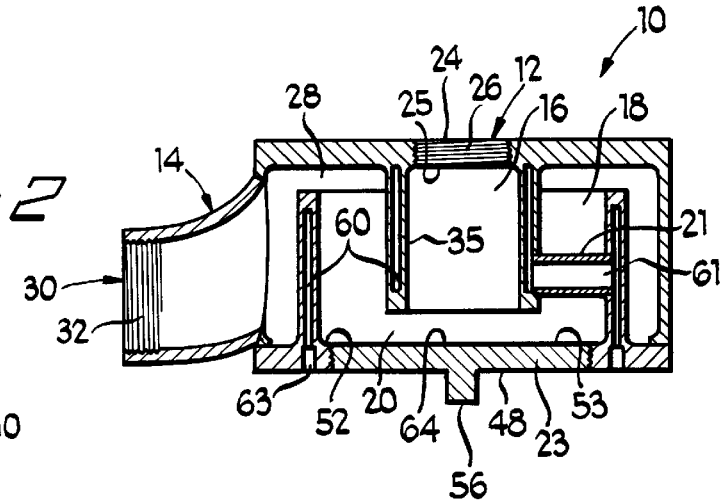
FIG. 2 of the drawings is a cross-sectional view of a first embodiment of the invention taken generally about lines 2—2 of FIG. 1.

Drain trap apparatus 10 is shown in FIGS. 1–2 as comprising fluid inlet 12, fluid outlet 14, first chamber 16, second chamber 18, transition region 20 (FIG. 2), cleaning member 23 (FIG. 2), and failure detection member 21 (FIG. 2). As will be understood, the drain apparatus is positioned to receive fluid from a system requiring a drain line. The apparatus may be made of plastic, such as PVC plastic, however, the apparatus may likewise comprise a metal casting as well as other type of material, as is known in the art.

Fluid inlet 12 is shown in FIG. 2 as comprising first end 24, second end 25 and threaded region 26. Threaded region 26 is configured to accept standard size pipe threads, however other types of specialty threads which may comprise outer or inner windings are contemplated for use. Additionally, while positive connections are shown, it should be understood that the connections may likewise comprise a slip type joint or other connection, such as a welded connection, among others, some of which may additionally require gaskets.

Where necessary, it is contemplated that the fluid inlet may likewise include a second, separate branch inlet 12' (FIG. 12) which is capable of accepting a auxiliary input such as one from the dishwasher, among other sources and accessories, which itself includes a first chamber and a transition region.

Fluid outlet 14 is shown in FIG. 2 as comprising entry region 28, outlet region 30 and threaded region 32. Just as with fluid inlet, threaded region 32 may comprise a standard size pipe thread which may be internal or external. Additionally, other types of connections, such as those identified above with respect to the inlet are likewise contemplated for use. Various configurations, including multiple outlets are contemplated for use.

First chamber 16 is shown in FIGS. 1 and 2 as comprising inner surface 35. Second chamber 18 likewise is shown in FIGS. 1 and 2 as comprising outer surface 36 and wall region 39, bottom surface 52 and opening 53. As shown in FIGS. 1 and 2, the first and second chambers comprise concentric circular chambers having varying diameters. As will be explained, opening 53 is designed to accept threaded plug member to facilitate cleaning.

Figure 12:
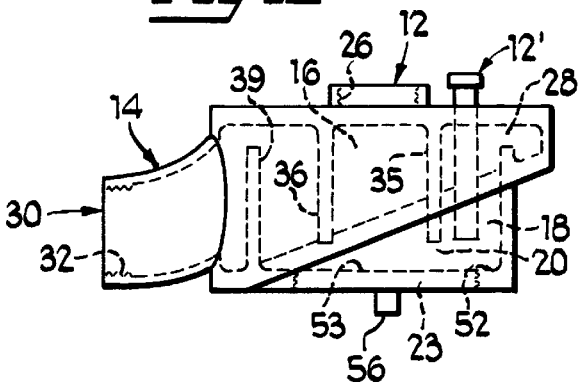
FIG. 12 of the drawings is a side elevation of another embodiment of the present invention, showing, in particular, an separate branch inlet and an alternate outlet configuration.

Of course, the two chambers may comprise other configurations, and, the two chambers may be interrelated with each other as described without being concentric. Indeed, a multitude of shapes and attachment configurations are contemplated for use. For instance, and as shown in FIG. 12, outlet region 30 may include an angled region to direct debris downstream and limit the debris that remains in the outlet.

As will be explained, transition region 20 comprises a region wherein the fluid passes from first chamber 16 to second chamber 18. The transition region is generally defined by the particular configuration and association of the first and second chambers, which it connects. It is important that the two chambers are associated so that the transition region remains submerged with fluid. For instance, as shown, first chamber may be positioned within second chamber to an extent to submerge the transition region; this relative position of the outlet and the first and second chambers provides the means for retaining the fluid to submerge the transition region. Of course, first and second chambers can be modified experimentally to achieve optimum configuration.

Cleaning member 23 is shown in FIG. 2 as comprising threaded plug member 48. Threaded plug member 48 includes outer threads and handle member 56. Threaded plug member is configured to matingly engage opening 53. It will be understood that this opening handle member 56 facilitates the engagement, and, in turn, threading of same. The cleaning member, when removed, exposes the inner regions of the trap, which can then easily and effectively be cleaned.

Failure detection means is shown in FIG. 2 as comprising voids 60, passage 61 and outlet 63, and plate region 64. Voids 60 are created within the wall separating the first chamber and the second chamber, as well as within wall region 39. Passage 61 connects the voids 60 ultimately to outlet 63. As will be explained, the regions proximate the voids are the weakest of the apparatus and these regions are designed to fail first. This in turn, will create a small leak from outlet 63, which will signal to the user that the trap is ready for replacement. Thus, the apparatus is replaced before a catastrophic failure results. Likewise, and as shown in FIG. 2, plate region 64 comprises a thinner area of material which is likewise designed to create a small leak (to indicate that replacement is needed) prior to a catastrophic failure. Of course, any combination of the voids, passages, and plate regions may be used, as well as other indicators of failure, including the releasing of dyes, among others, is likewise contemplated.

In operation, it is necessary to first attach the fluid inlet to a system supplying waste fluid. For instance, the apparatus may be used in association with the drain of a sink, vanity, shower, to name a few. Where the apparatus is used with the drain of a sink, the fluid inlet and the fluid outlet must first be attached to the respective portions of the system. As will be understood the fluid inlet is positioned upstream of the fluid outlet. Additionally, the attachment of the apparatus is shown to be a threaded fitting, however, a multitude of other attachment structures are likewise contemplated for use.

Once fully attached into the system, the apparatus is ready for use. When the fluid is introduced through the inlet, the fluid enters into first chamber 16. The fluid then proceeds along first chamber 16 to transition region 20 wherein the fluid, in turn, passes into the second chamber 18. As can be seen, inasmuch as the first chamber is positioned within the second chamber, as shown, the water radiates into the second chamber about the entire circumference (or perimeter depends on shape) of the first chamber. Thus, a radial flow is created. This three-dimensional, radial flow is advantageous because it is capable of accepting large flow volumes and advantageously deals with head pressures so that they are at acceptable and desired levels. Continued flowing of fluid through the apparatus eventually forces the fluid to extend out of second chamber 17 into entry region 28, and eventually through outlet region 30.

Once the fluid flow has stopped entering into the first chamber, the fluid continues to flow out of the outlet, until a stable equilibrium is reached. Inasmuch as the second chamber extends above the transition region, once the water has stabilized, as shown in FIG. 2, the water level remaining in the second chamber and the first chamber is such that the transition region remains submerged. As will be understood, the transition region will remain submerged so long as the second chamber wall extends vertically a distance beyond the transition region, which in turn, results in the lower end of fluid outlet 14 being at a level higher than transition region 20. The remaining fluid level creates a physical barrier between fluid inlet 12 and fluid outlet 14, which, in turn, prevents odors from returning through the water outlet into the water inlet.

Should the apparatus become clogged, cleaning of the first chamber, the second chamber and the transition region can be accomplished by removing cleaning member 23. Specifically, as explained above, cleaning member 23 is threaded into second chamber 18 in proximately the transition region. By rotating the cleaning member with the handle, the cleaning member can be threaded and removed, exposing the trap components. Then the inner components can then be cleaned out, or even flushed. When complete the cleaning member may be reinstalled. Accordingly, the entire trap apparatus can easily, quickly and effectively be cleaned.

After continuous exposure to the fluid, and the harmful constituents of the fluid, such as debris, wear occurs on the surfaces of the first chamber, the second chamber and the transition region. As explained, the apparatus includes certain regions that are designed to fail first, exposing a problem with the apparatus, and directing the user to replace the apparatus before a major failure occurs. For instance, wear through the walls of the first chamber or the holding wall introduces fluid into the inner cavities. Once introduced into these cavities, the fluid is eventually directed to opening 63, and a resulting drip will be evident as emanating from this opening. The user, upon identifying that a drip is emanating from opening 63, will realize that the apparatus has internal wear that will eventually amount to a major failure. Thus, the user is prompted to replace the unit. Additionally, the cleaning member may have a thin plate region 64, which is substantially thinner than the thickness of walls, and, upon wear, will result in a minimal drip. This drip will likewise indicate that the internal structure has deteriorated.

With respect to the following explanation of subsequent embodiments, elements having like function or structures are shown with like reference numerals.

Figure 4:
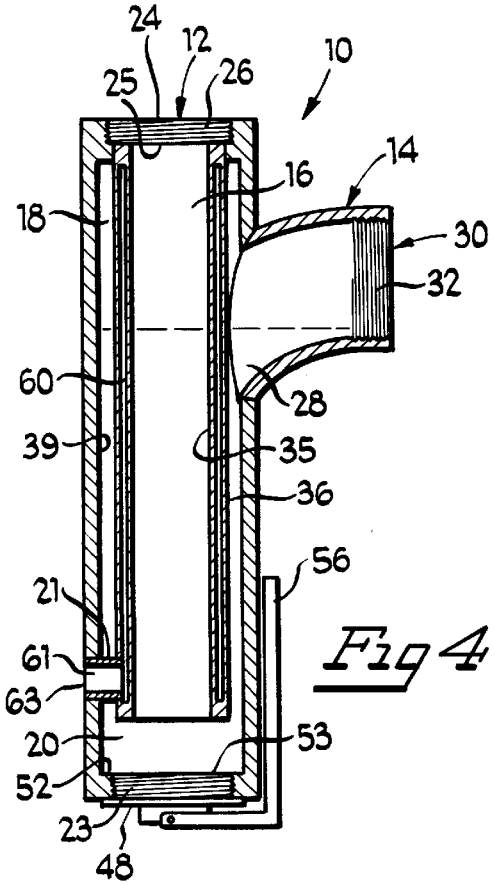
FIG. 4 of the drawings is a cross-sectional view of a second embodiment of the invention taken generally about lines 4—4 of FIG. 3.
Figure 3:
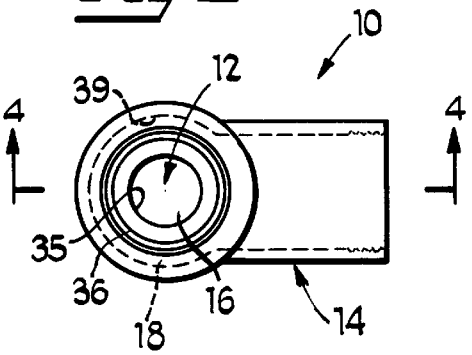
FIG. 3 of the drawings is a top view of second embodiment of the invention.

In a second embodiment as shown FIGS. 3 and 4, discloses a compact vertically oriented apparatus which operates in a similar fashion. In such an embodiment, the apparatus as shown, comprises a coaxial first and second chamber. In such an embodiment, the top of the second chamber is positioned above transition region 20. Such a placement serves to retain and maintain the transition region submerged as the outer wall of the second chamber in the first embodiment. Of course, first and second chambers can be modified experimentally to achieve optimum configuration for each application.

The operation of this embodiment is likewise quite similar to the first embodiment. Specifically, the fluid enters into the first chamber, then continues through transition region 20, radiating outward into second chamber. Subsequently, the fluid reaches entry region 28 of fluid outlet 16 and subsequently exits there. Once the fluid flow is stopped, a certain amount of fluid will remain, as can be seen from the water line, so that transition region 20 remains submerged.

A variation of the second embodiment can be seen in FIG. 5, wherein the apparatus is oriented such that the first chamber and the second chamber are not vertically oriented, but, rather oriented at an angle between the vertical and the horizontal. The particular angle of such inclination can be varied. Indeed, the main constraint is that the angle can only be such so as to maintain entry region 28 above the transition region 20, which will then maintain the transition region 20 submerged under substantially all conditions. Of course, it is contemplated that in such an embodiment, the first chamber 16 and the second chamber 18 can be modified in their configuration and shape, as long as the transition region can be maintained submerged.

In operation of this embodiment, flow enters into the first chamber, then proceeds through the second chamber extending out the fluid outlet. As can be seen in FIG. 5, when the flow of fluid ceases, a certain amount of water remains within the first and second chamber at an angle that is related to the angle of inclination of the device, successfully submerging the transition region. Such an embodiment takes up very little vertical space and facilitates easy cleaning thereof through the cleaning member.

A third embodiment is shown in FIGS. 6 and 7 as comprising second chamber mounted within the first chamber. In such an embodiment, fluid outlet 14 extends through second chamber 18 and into first chamber 16. In such an embodiment, first chamber 16 includes outer surface 236, inner surface 238, bottom surface 240 and opening 242. Additionally, second chamber 18 includes inner surface 246. In such an embodiment, cleaning member 23 is associated with opening 242.

In operation, the third embodiment functions much like the second embodiment, with the exception that the first chamber is mounted on the outside of the second chamber. As such, the fluid extends through the fluid inlet, then through the first chamber. Subsequently, as the fluid passes through the transition region, the fluid extends radially inward to the second chamber. Finally, the fluid outlet extends through the first chamber. In such an embodiment, when the fluid is stopped, a certain amount of fluid remains within the first and second chambers, essentially submerging the transition region.

As shown in FIG. 8 the third embodiment can be positioned at an angle with respect to the vertical. As with the second embodiment, the angle can be varied as desired so long as the transition region remains submerged. Additionally, the configuration of the first and second chambers can be modified to accommodate a variety of angles so long as the fluid entry region remains is above fluid entry region 28.

Figure 9:
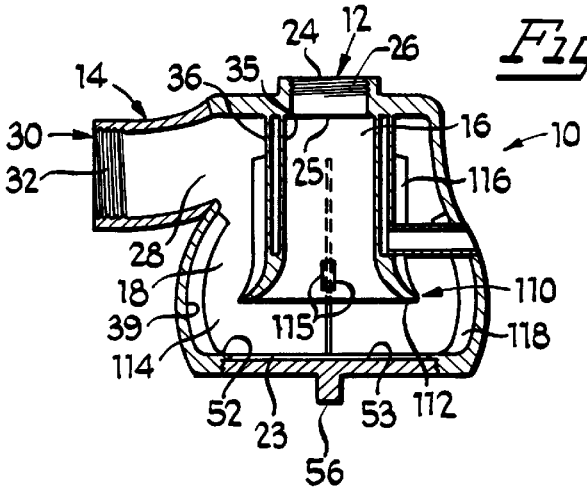
FIG. 9 of the drawings is a cross-sectional view of a fourth embodiment of the invention.

A fourth embodiment is shown in FIG. 9 of the drawings. Such an embodiment further includes means 110 for controlling flow characteristics. Flow characteristics means 110 includes nozzle region 112, lower region 114, diffussers 115, inner vanes 116, and outer vanes 118. Nozzle region 112 comprises an increasing diameter progressing from the first chamber to the transition to the second chamber. Further, diffussers 115 extend through inner surface 35 to outer surface 36—essentially from second chamber 18 to first chamber 16.

As can be seen in FIG. 9, lower region 114 is substantially bowed so as to accommodate a larger quantity of water than the upper region of the second chamber. Inner vanes 116 and outer vanes 118 are positioned 90° apart from each other symmetrically about both walls of the second chamber. While two diffussers are shown proximate each vane, multiple vanes and multiple diffussers at differing angles are likewise contemplated for use—and optimal settings for particular applications can be determined experimentally.

In operation, each of the nozzle region 112, lower region 114, diffussers 115, inner vanes and outer vanes 116, 118 respectively, work alone and in conjunction with each other to transform flow entering into first chamber 16 to a laminar flow exiting second chamber 18. Such flow control lessens the possibility of temporary venting and the build-up of back pressure within the trap. Indeed, any combination of flow control means components limits the turbulent flow conditions as the fluid proceeds through the trap. In such an embodiment, when the fluid flow ceases, the transition region, and the diffussers, remain submerged.

Figure 10:
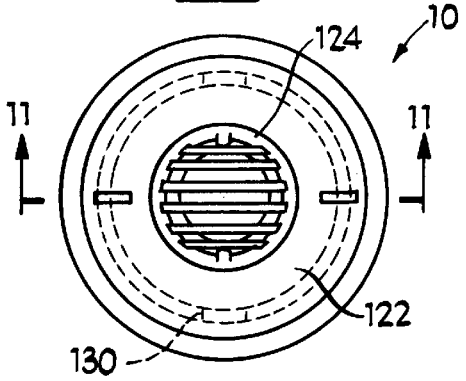
FIG. 10 is a top view of a fifth embodiment of the invention.
Figure 11:
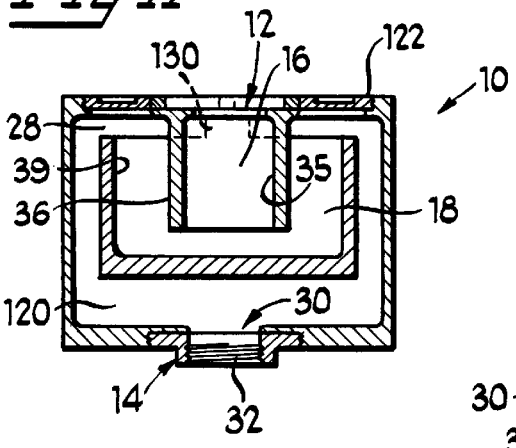
FIG. 11 of the drawings is a cross-sectional view of a fifth embodiment of the invention taken generally about lines 11—11 of FIG. 10.

A fifth embodiment is shown in FIGS. 10 and 11 of the drawings. This embodiment further includes base member 122 and inlet drain region 124. Additionally, water outlet 14 includes encasement member 120. First chamber is attached to drain region 124. Second chamber 18 is attached to base member 122 through tabs 130. As will be understood drain region is threadedly engaged with base member 122 which, in turn, is threadedly engaged to encasement region 120 of outlet 14. Of course, other attachment means for the base member 122 and the drain region 124 are likewise contemplated. Likewise, first chamber 16 may be conical so as to facilitate controlled inflow and controlled the outflow, with most efficient shape determined experimentally for the application.

In operation the fluid enters drain region 124, proceeds through first chamber 16, transition region 20, second chamber 18 to entry region 28 and, in turn, encasement region 120 of outlet 14. When the fluid stops flowing, as with other embodiments, fluid will submerge transition region 20, inasmuch as entry region 28 is above transition region 20.

Such an embodiment is quite advantageous as a shower drain, although it is not limited to such use. Generally, outlet 14, and, in particular, encasement region 120 will be submerged in concrete, and permanently fixed to the floor of the shower. Eventually, as with other embodiments, debris may clog the first and second chamber. Due to the configuration, it is likely that the debris will be concentrated about transition region 20. Additionally, failure is likely to occur in one of first and second chambers.

As such, to repair a clog, or to replace the first and second chamber, it is merely necessary to disconnect the base member from the encasement region 120 of outlet 14, which permits the removal of the two chambers for cleaning or replacement. Additionally, for many clogs, it is only necessary to disconnect the base member from the drain region to remove first chamber 16. Accordingly, virtually total replacement of a trap is facilitated without demolition of the floor of the shower and without disturbing the outlet and specifically encasement region 120 as well as other filings downstream. Additionally, the location could be utilized as a rodding station for the entire line.

Figure 13:
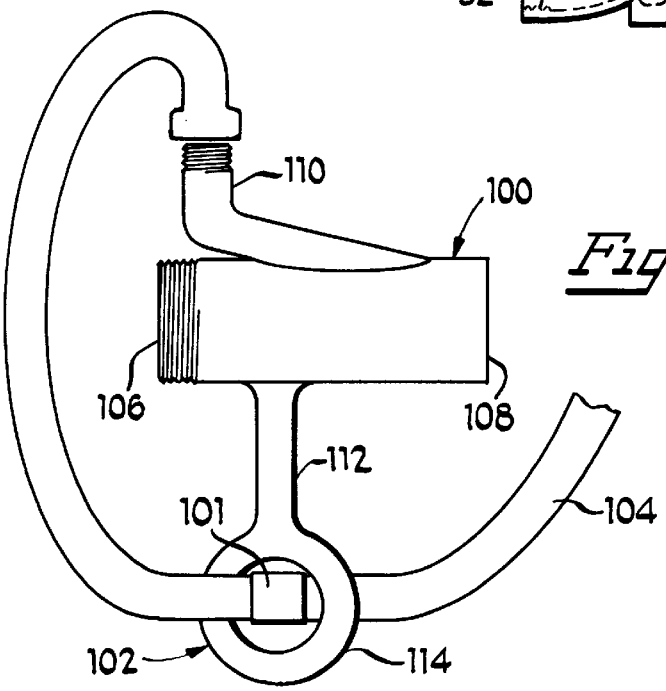
FIG. 13 of the invention is a side elevation of another embodiment of the invention.

A drainage trap is shown in FIG. 13 as comprising a main drainage pipe 100, a positioning member 102 and a flexible drainage line 104. Drainage pipe 100 includes inlet 106, outlet 108 and branch inlet 110. While drainage pipe 100 is primarily in a horizontal position with the inlet and the outlet shown to be co-linear, it is likewise contemplated that they may be positioned at an angle with respect to each other and that they may be positioned about an elbow or other configuration. Further, branch inlet is shown to connect with the main drainage pipe at an angle, however, other configurations are likewise contemplated. Moreover, while the branch inlet is shown as being smaller in size, it is likewise contemplated that it may be any number of sizes, such as, for instance, the size of the inlet and the outlet. Each of the inlet and the outlet are shown to include threaded fittings, however, other fittings and connections are likewise contemplated.

As shown in FIG. 13, positioning member includes leg member 112 and ring member 114. As will be explained, ring member and leg member serve to properly position the flexible drainage line in the proper orientation. The leg member is positioned 180° apart from the branch inlet, however, various positions are likewise contemplated for use. Additionally, it is likewise contemplated that the flexible line may be attached to inlet 106, and that the branch inlet may remained capped.

Flexible drainage line 104 comprises a line of conventional material which is flexible so that it may be bent without forming kinks or locks. Additionally, the flexible drainage line may include a coupling member 101 (as well as a y- or t-connection) which permits the selective coupling engagement and disengagement of the flexible drainage line proximate the positioning member. Accordingly, the flexible drainage line can quickly be assembled and disassembled for cleaning without unthreading the line from the branch inlet.

In operation, the drainage fluid from the device, such as a dishwasher, extends through the flexible drainage line, then extends to the branch inlet and, in turn, into the main drainage pipe. When the dishwasher (or other device) stops emitting fluid, due to the particular configuration, the fluid remains within the flexible line. As such, odor from the main drainage pipe will not extend back into the dishwasher, rather it will be blocked by the fluid remaining in the flexible line. As will be understood, such a configuration eliminates much additional hardware which is normally required to render the same advantages that are achieved by the above configuration.

The foregoing description and drawings merely explain and illustrate the invention and the invention is not limited thereto, as those skilled in the art who have the disclosure before them will be able to make modifications and variations therein without departing from the scope of the invention.

I claim:

1. A drainage trap comprising:

a main drainage pipe having an inlet, an outlet, and a branch inlet;

a positioning member associated with the main drainage pipe;

a flexible drainage line extending from an outside device, to the positioning member, and, in turn, into attachment with the branch inlet;

the positioning member facilitating the proper positioning of the flexible drainage line to facilitate the creation of a trap region.

2. The drainage trap according to claim 1 wherein the positioning member includes a leg member extending away from the main drainage pipe, the leg member including a ring member having a diameter sufficient to receive the flexible drainage line.

3. The drainage trap according to claim 1 wherein the positioning member is positioned on the opposite side of the branch inlet.

4. The drainage trap according to claim 1 wherein the branch inlet is angled at an acute angle with respect to the main drainage pipe and in the direction of flow of fluid therethrough.

5. The drainage trap according to claim 1 wherein the flexible drainage line includes a coupling proximate the positioning member for permitting releasable disengagement for purposes of cleaning.

* * * * *